United States Patent [19]

Anderson et al.

[11] 4,239,314

[45] Dec. 16, 1980

[54] ELECTRICAL CONNECTOR

[75] Inventors: Norman R. Anderson, Brookfield; Vladimir Tomsa, Chicago, both of Ill.

[73] Assignee: Bunker Ramo Corporation, Oak Brook, Ill.

[21] Appl. No.: 29,240

[22] Filed: Apr. 11, 1979

[51] Int. Cl.[3] ..... H01R 13/54

[52] U.S. Cl. ..... 339/89 M; 285/82

[58] Field of Search ..... 285/81, 82, 89, 317, 285/319, 309; 339/89 R, 90 C, 113 R

[56] References Cited

U.S. PATENT DOCUMENTS

| | | | |
|---|---|---|---|
| 2,728,895 | 12/1955 | Quackenbush et al. | 339/91 R X |
| 2,890,434 | 6/1959 | Ray et al. | 339/89 R |
| 3,202,956 | 8/1965 | Hennessey | 339/90 |
| 3,462,727 | 8/1969 | Blight et al. | 339/89 M |
| 3,478,302 | 11/1969 | Chirumbolo | 339/90 |
| 3,512,119 | 5/1970 | Cameron | 339/90 |
| 3,517,371 | 6/1970 | Buckley | 285/85 |
| 3,552,777 | 1/1971 | Heinrich et al. | 285/81 |
| 3,587,032 | 6/1971 | Normann | 285/86 X |
| 3,594,700 | 7/1971 | Nava et al. | 339/89 R |
| 3,601,764 | 8/1971 | Cameron | 339/89 M |
| 3,611,260 | 10/1971 | Colardeau et al. | 339/89 R |
| 3,699,472 | 6/1972 | Nadsady | 285/87 |
| 3,700,087 | 7/1973 | Vetter | 339/90 R |
| 3,786,396 | 1/1974 | Kemmer et al. | 339/89 R |
| 3,808,580 | 4/1974 | Johnson | 339/89 R |
| 3,892,458 | 7/1975 | Clark | 339/90 R |
| 3,917,373 | 11/1975 | Peterson | 339/89 R |
| 3,920,269 | 11/1975 | Anderson | 285/84 |
| 3,960,428 | 6/1976 | Naus et al | 339/90 R |
| 3,971,614 | 7/1976 | Paoli et al. | 339/89 R |
| 4,030,748 | 6/1977 | Paoli | 339/89 R |
| 4,066,315 | 1/1978 | Arneson | 339/89 M |
| 4,109,990 | 8/1978 | Waldron et al. | 339/89 M |

FOREIGN PATENT DOCUMENTS

| | | | |
|---|---|---|---|
| 1157282 | 11/1963 | Fed. Rep. of Germany . | |
| 1908540 | 9/1969 | Fed. Rep. of Germany . | |
| 1195451 | 5/1959 | France . | |
| 1297925 | 5/1962 | France . | |
| 566433 | 12/1944 | United Kingdom | 285/319 |
| 825579 | 12/1959 | United Kingdom . | |

*Primary Examiner*—Richard B. Lazarus
*Assistant Examiner*—Eugene F. Desmond
*Attorney, Agent, or Firm*—F. M. Arbuckle; J. R. Hoffman

[57] ABSTRACT

An electrical connector is disclosed and has complementary receptacle and plug connector members, each member having a hollow shell containing a conventional insulating insert which houses electrical contacts. A rotatable coupling ring is carried by the plug and is engageable with the receptacle for mating the connector members and holding the contacts in electrical engagement. A radially deflectable detent leaf spring is carried on an inner circumferential portion of the coupling ring, and the leaf spring has a radially extending detent protrusion intermediate the ends thereof and engageable with an annular array of ratchet-type detent teeth on an outer circumferential portion of the connector plug. The leaf spring is comprised of a pair of superimposed leaf portions joined together integrally at adjacent ends thereof by an enlarged loop portion. The loop portion is positionable within an axially exposed mounting recess at one end of the coupling ring. The leaf spring is elongated and arcuately shaped, and the axially extending detent portion is disposed on the one leaf portion which forms the concave side of the arcuate shape. The free end of the leaf spring rides along the inner circumferential portion of the coupling ring as the leaf spring is radially deflected by engagement of the detent protrusion thereof with the ratchet teeth of the connector plug.

18 Claims, 4 Drawing Figures

42
60
62
48
3
3
46
46a
46b
46c
46d
46e
16
36
50
42
46d
A
B
46e
56
54
14
52
32
48

ELECTRICAL CONNECTOR

BACKGROUND OF THE INVENTION

This invention relates generally to a preloaded electrical connector and, more particularly, to an electrical connector which has a pair of connector halves and detent means between one of the connector halves and a coupling ring which is freely rotatable thereto.

One form of a conventional electrical connector used today includes a plug and receptacle, each of which contains an insulative insert carrying one or more engageable contacts, whereby when the plug and receptacle are fully mated, the contacts are engaged to complete an electrical circuit therebetween. A bayonet-type connector coupling mechanism is frequently employed to positively retain the plug and receptacle of the connector in their fully mated positions. The bayonet coupling mechanism generally includes bayonets or pins projecting radially and associated with helical ramp tracks between the outer shell of one of the connector halves and the inside of a coupling ring. The ramp tracks have entrance portions at the forward or mating ends thereof into which the bayonets move into the tracks. Another form of conventional electrical connector used today includes a plug and receptacle, as described, and the plug and the receptacle are mated by a threaded connection between the receptacle and the coupling ring which is rotatably mounted on the plug.

While such arrangements are generally acceptable, it has been found that under extreme vibration, or after repeated connections and disconnections, the failure rate of the coupling mechanism tends to rise. The vibratory forces cause the pins of the bayonet-type connector to disengage from detent recess in the ramp tracks, whereupon the parts might seperate due to spring forces or, alternatively, frequent coupling and decoupling causes the pins to wear away the detent recess. With the threaded connectors, the threaded engagement may loosen or the threads themselves become worn due to vibration or repeated connections and disconnections. As the detent notches or the threaded connections wear away, vibration tends to become a more serious problem.

In order to solve these problems, many types of detent mechanisms have been provided to prevent accidental decoupling of the mated connector members, for instance under the aforsaid conditions of shock and vibration. Most such detent devices have been relatively complicated, have required a plurality of seperate components, and in most instances, the detent are disposed internally of the connector and thus require intricate assembly operations to mount the detent devices in place prior to final assembly of the connector. This invention relates, in part, to providing a new and improved detent mechanism which can be assembled and readily disassembled after the coupling ring is in proper assembled position on the connector plug.

One form of detent mechanism heretofore employed in connectors of the character described, has included a detent leaf spring which usually has a detent protrusion engageable within one or more detent recesses between the coupling ring and connector plug. One of the disadvantages of leaf springs for use in detent devices has been the limited resiliency afforded thereby. In addition, if the detent protrusion is formed integrally with the leaf spring, a concentrated stress point is created at the protrusion area resulting in a weak point which greatly increases the fail rate of the detent mechanism. This invention provides a new and improved leaf spring-type detent mechanism which has increased resiliency and decreased fail rate than heretofore provided.

SUMMARY OF THE INVENTION

Accordingly, the present invention is directed a providing a new and improved electrical connector which overcomes the particular difficulties and disadvantages associated with prior art connectors outlined above and which is particularly useful in conjunction with threaded coupling and decoupling mechanisms as well as with bayonet-type coupling mechanisms of the character described.

The principal object of the present invention, therefore, is to provide a new and improved electrical connector which employs a detent mechanism to prevent accidental decoupling of the mated connector members.

A feature of the present invention is the provision of means providing for easy assembly of the detent mechanism of the electrical connector as well as ready disassembly or replacement of the detent mechanism without dismantling the connector parts.

Another feature of the present invention is the provision of a new and improved spring leaf-type detent mechanism wherein the spring leaf has at least a pair of superimposed leaf protions which increase the resiliency of the leaf spring and reduce the fail rate thereof.

In the exemplary embodiment of the invention, an electrical connector is disclosed which includes first and second connector members in the form of a plug and receptacle each of which has a hollow shell containing a conventional insulating insert which houses one or more engageable electrical contacts therein, whereby when the plug and receptacle are fully mated, the contacts are engaged to complete an electrical circuit therebetween. A rotatable coupling ring is carried by the plug and is engageable with the receptacle for mating the connector members and holding the contacts in electrical engagement. Complementary interengaging connection means is provided between the coupling ring and the connector plug and, as disclosed herein, comprises a threaded coupling-decoupling connection. Detent means is provided between the coupling ring and the connector plug to prevent accidental decoupling of the mated connector members, such as under conditions of shock and vibration or under conditions of wear caused by repeated connections and disconnections.

The detent means of the present invention includes a radially deflective leaf spring mounted on an inner circumferential portion of the coupling ring. The leaf spring is elongated and has an integral radially inwardly extending detent protrusion intermediate the ends thereof and engageable with an array of ratchet-type detent teeth formed on an outer circumferential protion of the connector plug. The leaf spring is maintained under spring tension in engagement with the detent teeth so that rotation of the coupling ring relative to the connector plug deflects the leaf spring radially outwardly as the detent protrusion rides along the detent teeth of the connector plug.

One end of the detent leaf spring is provided with an enlarged integral loop portion which is anchored within an axially exposed mounting recess on the inner end of the coupling ring. With the recess being axially exposed, the leaf spring can be easily assembled and readily removed or replaced exteriorly of the connector without dismounting the connector parts. More particularly, a back-up washer bears against the loop portion of the leaf spring on the outside end of the coupling ring to maintain the leaf spring with the loop portion thereof anchored within the axially exposed recess in the coupling ring. A readily removable snap ring on the connector plug holds the back-up washer against the leaf spring.

The leaf spring of the present invention comprises a pair of integral superimposed leaf portions joined together at adjacent ends thereof by the aforesaid enlarged loop portion of the leaf spring. The superimposed leaf portions provide for increased resiliency of the leaf spring. The leaf spring is arcuately shaped, and the radial detent protrusion thereof is formed integral with the leaf portion which forms the concave side of the arcuate shape. The leaf portion which forms the convex side of the arcuate shape is effective to more evenly distribute stress along the other leaf portion and thereby eliminate weak spots, particularly at the detent protrusion, mostly reducing the fail rate of the detent mechanism.

The ramp angles of the detent teeth on the connector plug are varied to produce a higher torgue value in the decoupling direction between the connector plug and the coupling ring than in the coupling direction.

Other objects, features and advantages of the invention will be apparent from the following detailed description taken in connection with the accompanying drawings.

DETAILED DESCRIPTION OF THE INVENTION

Figure 1:
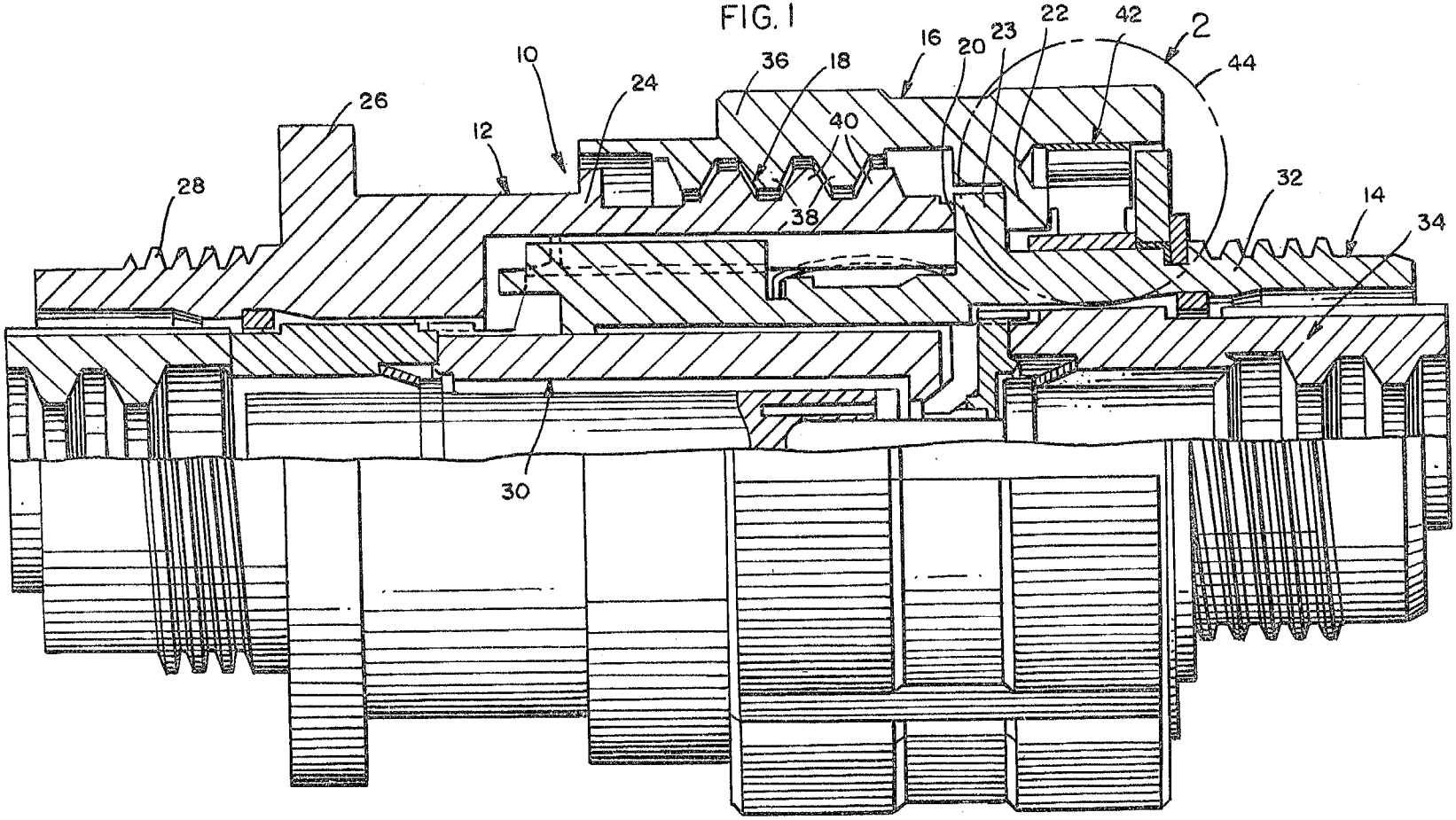
FIG. 1 is a central vertical sectional view through a plug and receptacle-type electricall connector embodying the detent means of the present invention.

Referring to the drawings in greater detail, the electrical connector of the present invention is a socket-type connector, generally designated 10 in FIG. 1, and includes a receptacle connector member, generally designated 12, and a plug connector member, generally designated 14. The mechanical connection between the receptacle connector member 12 and the plug connector member 14 is accomplished by means of an overlying coupling ring, generally designated 16, carried by the plug. A threaded coupling-decoupling connection, generally designated 18, is provided between the connector receptacle 12 and the coupling ring 16, and the connector plug 14 is drawn axially into fully mated engagement with the connector receptalce 12 (as at 20) by engagement between an inner circumferential flange 22 of the coupling ring 16 and an outer circumferential flange 24 of the connector plug 14.

The connector receptacle 12 is conventional and known in the art and includes a receptacle shell 24 which is a generally tubular metal member of circular cross-section and which may include a mounting flange 26 whereby the receptacle may be fixedly secured to an associated stationary support member by conventional fasteners. The connector receptacle 12 also includes a threaded end 28, as is conventional and known in the art, for additional mounting purposes. An insulating insert member and associated components, generally designated 30, is disposed within the receptacle 12 and serves to retain and hold a plurality of electrical contacts (not shown) in a customary and known fashion. The details of the electrical contacts and their insulation in the receptacle 12 and the plug 14 form no part of the present invention and therefore are not described in detail other than what is shown in the drawings.

The connector plug 14 comprises a generally circular tubular metal member defining a shell 32 constructed for interlocking engagement with the receptacle 12. An insulative insert member 34 is disposed within the shell 32 and carries at least one and generally a plurality of electrical contacts (not shown) in a customary and known fashion. The shell 32 is provided with the aforesaid radially outwardly protruding annular engaging flange 24 which, when the plug shell 32 and receptacle shell 24 are in proper engaged position, provides an abutment shoulder, as at 20, which engages the terminal or inner end of the receptacle shell 24, as shown in FIG. 1. Alternatively, the opposing mating faces if the plug and receptacle inserts 34 and 30, respectively, may form the abutting interface of the connector member 12 and 14, in which case the terminal end of the receptacle shell 24 may be slightly spaced from the plug flange 23.

Appropriate means, which will not be described herein as in that it forms no part of the invention, is provided between the connector plug shell 32 and the connector receptacle shell 24 to assure proper alignment and thus proper mating engagement of the electrical contacts. Customarily, one or more axially extending, outwardly protruding ribs or keys about the outside of the plug shell 32 are positionable within keyways formed in the inside of the receptacle shell 24. The key and keyways are provided not only to align the plug 14 and receptacle 12, but also to preclude relative rotational movement between those parts when properly assembled.

The coupling ring 16 is provided for securing the connector plug 14 and the connector receptacle 12 in their relative mated positions and is carried by and circumscribes the plug shell 32. The coupling ring 16 is defined by a generally circular tubular metal shell 36 which is provided with interior circumferential threads 38 which extend inwardly generally from the forward end thereof ( the left hand end as viewed in FIG. 1). Complementary threads 40 are provided on the outside of the receptacle shell 24 for threading engagement with the threads 38 of the coupling ring 16. With this threaded connecting means, as the coupling ring is rotated relative to the connector plug, the connector plug and connector receptacle are drawn together until the outwardly extending circumferential flange 23 of the connector plug abuts against the inner end of the connector receptacle, as at 20, to define the fully mated condition of the connector.

Figures 2, 3, 4:
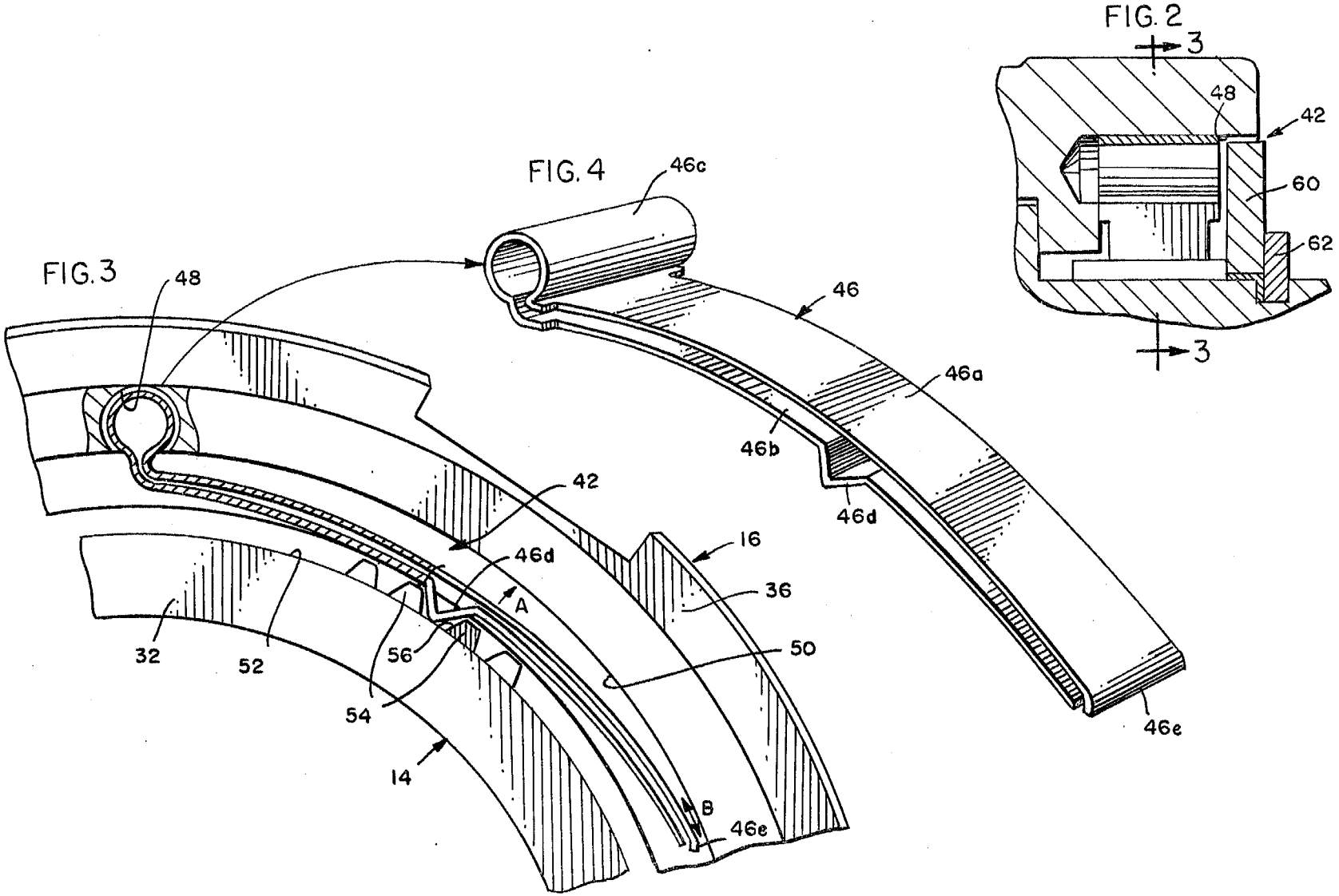
FIG. 2 is a fragmentary vertical sectional view, on an enlarged scale, of the encircled portion of FIG. 1.
FIG. 3 is a fragmentary vertical sectional view, taken generally along line 3—3 of FIG. 2.
FIG. 4 is a perspective view of the detent leaf spring of the present invention.

In accordance with the present invention, detent means, generally designated 42, is provided between the coupling ring 16 and connector plug 14 (in particular, the plug shell 32) to prevent accidental decoupling of the mated connector members 12, 14 primarily under conditions of shock and vibration, or under conditions where the threaded connection 18 between the connector plug 14 and the connector receptacle 12 becomes worn through repeated connections and disconnections. The detent means 42 is encircled by the dotdash circle 44 in FIG. 1 and is enlarged in the corresponding view thereof shown in FIG. 2. The detent means 42 include a radially deflectable leaf spring, generally designated 46 and shown in perspective in FIG. 1. The leaf spring 46 has a pair of integral superimposed leaf spring portions or arms 46*a* and 46*b* which are generally arcuately shaped, as seen in FIGS. 3 and 4. The leaf portions or arms 46*a* and 46*b* are joined at adjacent ends (the left ends as viewed in FIGS. 3 and 4) by integral loop portion 46*c* which is generally tubular or cylindrical in shape, as seen in FIG. 4. A radially extending detent protrusion or lug 46*d* is formed integral with the leaf portion 46*b* generally intermediate the ends thereof. The leaf portion 46*a* has a transverse rounded flange 46*e* at the distal end thereof, the right hand end as viewed in FIGS. 3 and 4.

The detent leaf spring 46 is anchored to the inside of the coupling ring 16 by means of an axially exposed mounting recess 48 which receives the loop portion 46*c* of the leaf spring. As shown in FIG. 3, the rounded flange 46*e* at the distal end of the leaf portion 46*a* of the leaf spring 46 engages and is freely movable relative to an inside circumferential recess 50 (FIG. 3) of the coupling ring 16. An outer circumferential portion 52 of the connector plug shell 32 is provided with a plurality of detent ratchet-like teeth 54 which form detent recesses 56 therebetween. As seen best in FIG. 3, the radially extending detent protrusion or lug 46*d* of the detent spring rides along the array of detent teeth 56, the latter of which extends completely about the circumferential portion 52 of the connector plug shell 32 so that the detent or ratcheting action between the leaf spring and the ratchet teeth functions at all times, i.e., for the entire coupling and decoupling action of the connector of the present invention.

As the coupling ring 16 is rotated relative to the connector plug 14, the detent teeth 46 effect radial deflection of the leaf spring 46 by engagement with the detent lug 46. As the leaf spring 46 deflects outwardly in the direction of arrow A (FIG. 3), the distal end defined by the flange 46*e* of the leaf portion 46*a*, thereof is free to move along the inside of the circumferential recess 50 of the coupling ring 16, as indicated generally by the double headed arrow B in FIG. 3. With this unique double leaf construction of the detent leaf spring 46, as afforded by the two leaf portions 46*a* and 46*b*, flexing stresses are distributed along the length of the leaf spring notwithstanding the integrally formed detent lug 46 intermediate the ends of the leaf portion 46*b*. More particularly, the integrally formed detent lug 46 normally would create a stress concentration point or area, and bending or flexing action actually would take place at the lug. This is a major problem with leaf spring detents heretofore known. After repeated connections and disconnections of the connector, a spring set develops in the area of the detent lug. Consequently the resiliency of the leaf spring is greatly reduced, and the fail rate of the connector increases dramatically. This is particularly a severe problem with anti-vibration connectors. With the unique double thickness construction of the detent leaf spring of the present invention, the uninterrupted leaf portion 46*a* acts as a backup means for the leaf portion 46*b* and effectively distributes flexing stresses substantially uniformly along the length of the leaf spring. The life of the leaf spring is mostly increased, resulting in a dramatic reduction in the fail rate of the connector itself. The flexibility of the leaf spring also is enhanced because the leaf portions 46*a* and 46*b* are capable of sliding movement relative to each other, the enlarged loop 46*c* of the leaf spring is capable of freely rotating within the mounting or anchoring recess 48 of the coupling ring 16, and the distal end of the leaf spring defined by the flange 46*e* is capable of generally tangential movement as it rides along the inside of the circumferential recess 50 of the coupling ring.

In order to maintain or hold the leaf spring 46 within the coupling ring 16, i.e., the loop portion 46*c* of the leaf spring within the exposed recess 48 of the coupling ring, a backing member in the form of a washer 60 (FIGS. 1 and 2) is provided at the outer end of the recess 48. A snap ring 62 is provided for snapping onto adjacent outer circumferential portion of the connector plug shell 32 to sandwich the washer 60 between the snap ring and the leaf spring 46. With this construction, it can be seen that the detent leaf spring 46 can be positioned within the coupling ring 16 from the exterior of the connector simply by removing the snap ring 62 and the backing washer 60. Should the leaf spring have to be removed or replaced for any reason, easy access thereto is afforded by this construction, contrary to most detent means heretofore available which customarily are disposed completely interiorly of the connector. The backing washer 60 also comprises means to hold the coupling ring 16 in position circumscribing the connector plug 60, with the interior annular flange 22 (FIG. 1) of the coupling ring is engagement with the outwardly protruding annular flange 23 of the connector plug.

It is contemplated that the detent ratchet-type teeth 54 circumscribing the connector plug shell 32 are formed so that the sides or ramps of the teeth are variably angled on opposite sides of the teeth so that the torque required to rotate the coupling ring 16 in a decoupling direction is greater than that required to rotate the coupling ring in the coupling direction. This reduces unintentional unmating of the connector. It can be seen from the foregoing description of the invention that there has been provided a new and improved electrical connector in which a mechanism is provided to prevent accidental decoupling of the mated connector plug and shell, for instance, under extreme conditions of shock and vibration, or after repeated connections and disconnections of the connector by the threaded connecting means 18. The detent leaf spring is disposed for easy access from the exterior of the connector for assembly and disassembly or replacement purposes. The novel unitary construction of the dual-leaf detent spring provides for greater resiliency than heretofore available, and mostly reduces the fail rate of the detent mechanism and, in turn, the connector itself.

While in the foregoing specification a detailed description of the invention has been set forth for purposes of illustration, variations of the details herein given may be by those skilled in the art without departing from the spirit and scope of the invention as set forth in the appended claims.

We claim:

1. An electrical connector comprising first and second connector members, each connector member including interengageable contact means adapted for axial connection in electrical engagement with the contact means of the other connector;

a coupling ring carried by one of said connector members for rotation relative thereto;

complementary interengaging connection means between said coupling ring and the other of said connector members; and detent means between said coupling ring and said one connector member, said detent means including a radially deflectable leaf spring on one of said coupling ring or said one connector member, said leaf spring including at least a pair of superimposed leaf portions, a detent protrusion on one of said leaf portions between the ends thereof, and the other of said leaf portions providing a backup means against said one leaf portion to distribute flexing stresses along the length thereof and to limit bending or flexing in the area of said detent protrusion.

2. The electrical connector of claim 1 wherein the other of said coupling ring or said one connector member has an annular array of ratchet-type teeth engageable by said detent protrusion.

3. The electrical connector of claim 1 wherein said superimposed leaf portions are integrally joined at adjacent ends thereof.

4. The electrical connector of claim 3 including an enlarged integral loop portion joining said adjacent ends of said leaf spring.

5. The electrical connector of claim 1 wherein said leaf spring is elongated and including means for anchoring one end of said leaf spring to one of said coupling ring or said one connector member, with the other end of said leaf spring being freely movable relative to said coupling ring and said one connector member.

6. The electrical connector of claim 4 wherein one of said coupling ring or said one connector member has a circumferential surface portion and said leaf spring is arcuately shaped, with said other end of said leaf spring being engageable with and freely movable along said circumferential surface portion.

7. The electrical connector of claim 6 wherein said detent protrusion on said one leaf portion is on the concave side of said arcuate shape.

8. The electrical connector of claim 7 wherein said detent protrusion is disposed generally centrally of said one leaf portion.

9. The electrical connector of claim 7 wherein the other of said coupling ring or said one connector member has an annular array of ratchet-type teeth engageable by said detent protrusion.

10. An electrical connector comprising first and second connector members, each connector member including interengageable contact means adapted for axial connection in electrical engagement with the contact means of the other connector;

a coupling ring carried by one of said connector members for rotation relative thereto;

complementary interengaging connection means between said coupling ring and the other of said connector members; and detent means between said coupling ring and said one connector member, said detent means including a leaf spring which comprises at least a pair of superimposed leaf portions, one leaf portion having a detent protrusion between the ends thereof and the other leaf portion providing a backup means against said one leaf portion to distribute flexing stresses along the length thereof and to limit bending or flexing in the area of said detent protrusion.

11. The electrical connector of claim 10 wherein the other of said coupling ring or said one connector member has an annular array of ratchet-type teeth engageable by said detent protrusion.

12. The electrical connector of claim 10 wherein said superimposed leaf portions are integrally joined at adjacent ends thereof.

13. The electrical connector of claim 12 including an enlarged integral loop portion joining said adjacent ends of said leaf spring.

14. The electrical connector of claim 10 wherein said leaf spring is elongated and including means for anchoring one end of said leaf spring to one of said coupling ring or said one connector member, with the other end of said leaf spring being freely movable relative to said coupling ring and said one connector member.

15. The electrical connector of claim 14 wherein one of said coupling ring or said one connector member has a circumferential surface portion and said leaf spring is arcuately shaped, with said other end of said leaf spring being engageable with and freely movable along said circumferential surface portion.

16. The electrical connector of claim 15 wherein said detent protrusion on said one leaf portion is on the concave side of said arcuate shape.

17. The electrical connector of claim 16 wherein said detent protrusion is disposed generally centrally of said one leaf portion.

18. The electrical connector of claim 16 wherein the other of said coupling ring or said one connector member has an annular array of ratchet-type teeth engageable by said detent protrusion.

* * * * *